US010395858B2

(12) United States Patent
Nowak, Jr.

(10) Patent No.: US 10,395,858 B2
(45) Date of Patent: Aug. 27, 2019

(54) REPLACEABLE TRIGGER COMPONENTS

(71) Applicant: Snap-on Incorporated, Kenosha, WI (US)

(72) Inventor: Dennis A. Nowak, Jr., Franklin, WI (US)

(73) Assignee: Snap-on Incorporated, Kenosha, WI (US)

( * ) Notice: Subject to any disclaimer, the term of this patent is extended or adjusted under 35 U.S.C. 154(b) by 489 days.

(21) Appl. No.: 14/637,468

(22) Filed: Mar. 4, 2015

(65) Prior Publication Data

US 2016/0260557 A1 Sep. 8, 2016

(51) Int. Cl.

| | |
|---|---|
| ***H01H 13/50*** | (2006.01) |
| ***H01H 11/00*** | (2006.01) |
| ***H01H 13/06*** | (2006.01) |
| ***H01H 9/06*** | (2006.01) |

(52) U.S. Cl.

CPC ..... *H01H 13/06* (2013.01); *H01H 9/06* (2013.01); *H01H 2231/048* (2013.01)

(58) Field of Classification Search

CPC ..... H01H 9/06; H01H 13/06; H01H 11/00; H01H 13/50; H01H 2231/048

USPC ..... 173/168

See application file for complete search history.

(56) References Cited

U.S. PATENT DOCUMENTS 3,624,820 A * 11/1971 Brown ..... B25B 21/02 137/614.17
4,241,297 A 12/1980 Pearson et al.
4,258,798 A * 3/1981 Campbell ..... B23B 45/04 173/168
4,776,561 A * 10/1988 Braunlich ..... B25B 21/00 173/169
4,844,177 A * 7/1989 Robinson ..... B25B 23/145 173/169
5,370,037 A 12/1994 Bauer et al.
5,788,219 A 8/1998 Nakajima
6,923,272 B2 * 8/2005 Jansson ..... B25F 5/00 173/168

FOREIGN PATENT DOCUMENTS

| | | |
|---|---|---|
| CA | 2791328 | 3/2013 |
| DE | 202007005959 U | 9/2007 |
| JP | 20080221382 | 9/2008 |

OTHER PUBLICATIONS

Canadian Office Action; dated Sep. 27, 2016; 4 pgs.
Australian Government Patent Examination Report, dated Mar. 11, 2016; 7 pages.

(Continued)

*Primary Examiner* — Robert F Long
*Assistant Examiner* — Xavier A Madison
(74) *Attorney, Agent, or Firm* — Seyfarth Shaw LLP

(57) ABSTRACT

A trigger retention mechanism for a device that includes a depressible trigger and a bushing releasably coupled to a housing by a releasable fastener, such as an E-clip. The retention mechanism can also include O-rings to provide an air-tight seal between the bushing and the housing. To replace the retention mechanism, a user need only release the fastener and pull the bushing outwardly from its position within the housing, rather than replacing the entire handle or trigger assembly.

18 Claims, 3 Drawing Sheets

(56) References Cited

OTHER PUBLICATIONS

UK Intellectual Property Office, Combined Search and Examination Report under Sections 17 and 18(3); dated Apr. 29, 2016; 6 pgs.
Taiwan Office Action for Application No. 104142408 dated Jun. 6, 2017, 5 pages.
Canadian Examination Report for Application No. 2907343 dated Jun. 13, 2017, 4 pages.
Chinese Office Action for Application No. 201510877005.7 dated Apr. 16, 2018, 8 pages.
UK Office Action for Application No. GB1522038.7 dated Jul. 18, 2018, 4 pages.

* cited by examiner

REPLACEABLE TRIGGER COMPONENTS

TECHNICAL FIELD OF THE INVENTION

The present invention relates generally to replaceable trigger retention components. More particularly, the present invention relates to a trigger retention mechanism for a power tool that allows for replacement of the trigger components.

BACKGROUND OF THE INVENTION

Power tools typically use depressible triggers or buttons to initiate operation. For example, an electric drill includes a trigger that a user depresses to operate the drill. Other depressible triggers or buttons can be used on the tool as well. For example, in addition to the operation trigger, the drill can include a reversing mechanism to change the rotational direction of operation of the drill, for example from clockwise or counterclockwise.

Trigger or depressible button mechanisms of such tools are typically retained in the housing of the tool, for example, within the hard, plastic external wall of the housing. Over time, the housing can wear due to the continual depressing of the trigger or button body while operating the tool. Wear of the housing surrounding the trigger can result in air or water leakage into the tool, and generally threatens the structural stability of the trigger and housing interface.

Moreover, some of these depressible buttons or triggers are constructed with a body that the user can depress, and then coupled with some form or a trigger stem that transfers the user's depressing action to an internal component of the tool. These stems are often guided within a cylinder or hole, and, to ensure that there remains a liquid-tight or air-tight interaction, an O-ring is typically used on the stem. Therefore, the O-ring provides a substantially air-tight or liquid-tight interaction between the stem and the inner wall of the cylinder or wall. However, because of the continual axial translation between the stem and the cylinder caused by the repeated depressing of the button or trigger, the O-rings eventually wears out, and thus, the liquid-tight or air-tight interaction between the stem and the inner wall of the cylinder no longer exists or is severely diminished. This can result in air or fluid leaking from the tool, for example, with a pneumatically or hydraulically operated tool, resulting in power loss or aggravation of the user. Other tools include a bushing assembly for the interface, which still results in the same, eventual failure. Therefore, the O-ring or bushing often requires replacement during the life of the tool, but existing depressible buttons and triggers lack an easy way to disassemble the triggers without destroying to tool or button.

SUMMARY OF THE INVENTION

An embodiment of the present invention broadly comprises a trigger retention mechanism for a power tool that facilitates replacement of components of a depressible trigger or button. The trigger retention mechanism includes a bushing retained in a housing with a releasable fastener, such as an E-clip. In some embodiments, the retention mechanism can include one or more O-rings disposed on the outer diameter of the bushing to provide a substantially air-tight or liquid-tight seal between the bushing and the housing. The bushing can be disposed in the housing to prevent axial movement of the bushing and the retention mechanism. To release the retention mechanism to access replaceable components, a user need only remove the releasable fastener and pull the bushing from its position within the housing.

An embodiment of the present invention broadly includes a trigger retention mechanism that allows access to and replacement of components of a depressible trigger, including a trigger having a trigger body and a trigger stem extending from the trigger body, a bushing having a tube adapted to slidably receive the trigger stem, the bushing adapted to be friction-fit in a housing of a tool, and a fastener adapted to releasably couple the bushing to the housing and substantially prevent axial movement of the bushing.

Another embodiment includes a tool having a depressible trigger with a trigger body and a trigger stem extending from the trigger body, a housing, a bushing having a tube adapted to slidably receive the trigger stem, wherein the bushing is adapted to be friction-fit in the housing, and a fastener adapted to releasably couple to the bushing to substantially prevent axial movement of the bushing relative to the housing.

Yet another embodiment is a method of repairing trigger components, including removing a fastener releasably coupled around a tube of a bushing that substantially prevents axial movement of the bushing relative to a housing, applying a force to a flange extending from the tube to overcome a friction-fit interaction between the tube and a housing of a tool, and replacing components that require replacement.

BRIEF DESCRIPTION OF THE DRAWINGS

For the purpose of facilitating an understanding of the invention, there are illustrated in the accompanying drawings embodiments thereof, from an inspection of which, when considered in connection with the following description, the invention, its construction and operation, and many of its advantages should be readily understood and appreciated.

DETAILED DESCRIPTION OF THE EMBODIMENTS

Figure 1:
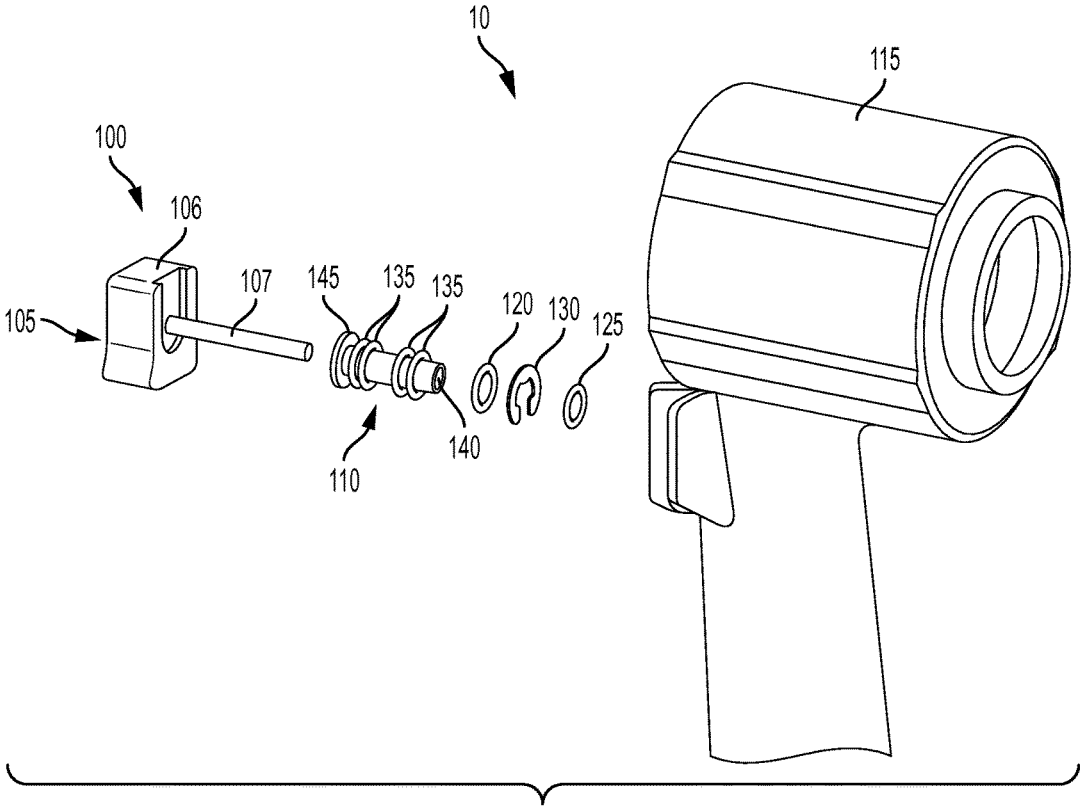
FIG. 1 is an exploded side perspective view of a tool according to embodiments of the present invention.

While the present invention is susceptible of embodiments in many different forms, there is shown in the drawings, and will herein be described in detail, embodiments of the invention, including a preferred embodiment, with the understanding that the present disclosure is to be considered as an exemplification of the principles of the invention and is not intended to limit the broad aspect of the invention to embodiments illustrated.

An embodiment of the present invention broadly comprises a trigger retention mechanism for a power tool including a bushing releasably coupled to a housing with a fastener, such as an E-clip. The retention mechanism can also include one or more O-rings that provide a substantially air-tight or liquid-tight seal between the bushing and the housing. The O-rings can interface with the housing to inhibit axial movement of the bushing relative to the housing during use of the tool. Yet, when internal components require replacement or repair, the retention mechanism can be removed by removing the releasable fastener and pulling the bushing outwardly from its position within the housing, allowing replacement of the retention mechanism or any the individual components of the depressible trigger or button mechanism.

Figure 2:
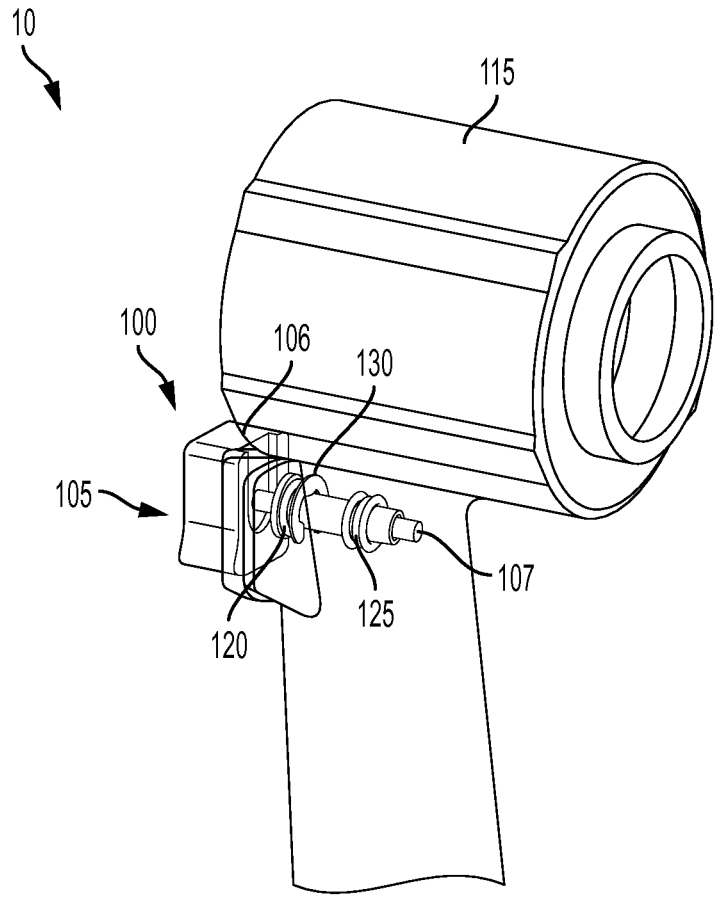
FIG. 2 is a side perspective view of an assembled tool according to embodiments of the present invention.

Referring to FIGS. 1 and 2, a tool 10 can include a retention mechanism 100 for maintaining a depressible button or trigger 105 within a housing of a tool 10. The trigger 105 can include a trigger body 106 and a trigger stem 107 coupled to or integral with and extending from the trigger body 106. The trigger stem 107 is adapted to slidably extend into a bushing 110, which is adapted to allow slidable, axial movement of the trigger stem 107, such as when the trigger 105 is depressed. In some embodiments, the trigger 105 and bushing 110 can be inserted into a housing 115 of the tool 10, where the bushing 110 is retained within the housing 115 by any combination of one or more O-rings 120, 125, and a releasable fastener 130.

The bushing 110 can be releasably coupled within the housing 115 of the tool 10 to allow the trigger 105 to axially translate relative to the tool 10 via the slidable interaction between the bushing 110 and the trigger stem 107. For example, the bushing 110 can include a circumferentially disposed groove 135 adapted to retain one or more O-rings 120, 125 and, in some embodiments, frictionally engage the bushing 110 within the housing 115. The bushing 110 can also include a tube 140 adapted to slidably receive the trigger stem 107 and allow insertion of the trigger 105 into the housing 115 so the trigger 105 is operably coupled to the tool 100. In some embodiments, the bushing 110 can also include an annular flange 145 extending from the tube 140 that abuts an external wall of the housing 115 when inserted, for example, substantially flush with the external wall. Accordingly, the flange 145 can prevent the retention mechanism from entering the housing 115 completely while still ensuring that the retention mechanism is fully seated in the housing 115.

Figure 3:
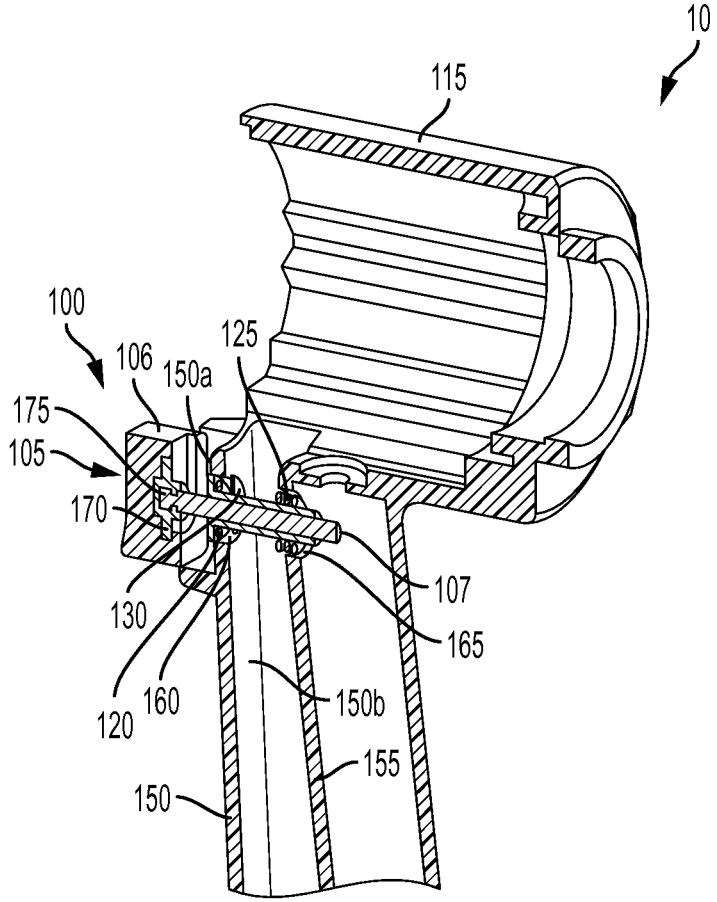
FIG. 3 is a side sectional view of a tool according to embodiments of the present invention.

The releasable fastener 130 can be any device, object, or substance adapted to releasably couple two or more objects together. For example, the fastener 130 can be an E-clip, cotter pin, screw, nail, rivet, bolt, nut, adhesive, tape, or any other means of releasably coupling two or more objects together or to another object. As shown, the fastener 130 can be an elastic E-clip that couples circumferentially around the tube 140 to releasably retain the retention mechanism 100 in place relative to the housing 115. For example, the E-clip can couple circumferentially around the tube 140 inside the housing 115 proximate an internal surface of a wall of the housing 115 for a more secure arrangement, as shown in FIGS. 2 and 3.

The fastener 130 and flange 145 can sandwich a first wall 150 of the housing 115 to securely retain the retention mechanism 100 within the housing 115 with minimal axial movement of the bushing 110 relative to the housing 115. For example, the first wall 150 can include a first surface 150*a* facing an external side of the housing 115, and a second surface 150*b* facing an internal side of the housing 115. In some embodiments, the housing 115 can also include a second wall 155 inside the housing 115 that receives the tube 140 and maintains the bushing 110 in place. For example, as shown in FIG. 3, a first O-ring 120 can frictionally engage the first wall 150 within a first opening 160 of the first wall 150. Similarly, a second O-ring 125 can frictionally engage the second wall 155 in a second opening 165. The ridges 135 surrounding the first O-ring 120 can also be friction-fit within the first wall 150, and similarly, the ridges 135 surrounding the second O-ring 125 can be friction-fit with the second wall 155. It will be appreciated that use of the O-rings can provide a substantially air-tight or liquid-tight seal between the housing 115 and the bushing 110, when the bushing 110 is seated in the housing 115. In some embodiments, each of the O-rings 120, 125 are surrounded by two ridges 135, and each of the ridges 135 sandwich the walls 150, 155 for a more secure frictional-fit interaction. However, for ease of replacement, the ridges 135 may be friction-fit within walls 150, 155 and retained in place by the fastener 130 around the tube 140 of the bushing 110.

Embodiments of the present invention allow a user can easily remove or replace the trigger retention mechanism 100 and operable trigger components that are normally internally disposed within the tool by first removing the releasing fastener 130, and then pulling on the bushing 11 outwardly relative to the housing 115, for example with the flange 145, to overcome the friction-fit interaction between the bushing 110 and the housing 115. After removing the retention mechanism 100, the user can then insert a new bushing 110 or retention mechanism 100 into the housing 115 by, or replace other internal components, for example the trigger stem or O-rings. Prior to re-inserting the bushing 110 or retention mechanism 100, the user can situate O-rings 120, 125 within the ridges 135 to provide for a substantially air and water tight seal of the retention mechanism 100 against the housing 115.

Embodiments of the present invention allow easy removal or replacement of the depressible trigger or button, because of the retention mechanism 100, so internal trigger components can be replaced. Also, by implementing a removable bushing 110 rather than a hole in the housing 105, the mechanism 100 avoids many of the wear issues shown in conventional depressible trigger components, and eliminates the need to replace the handle 115 where other existing designs require the bushing to be affixed to the handle. Additionally, because the mechanism 100 is easily retained with the fastener 130, it is structurally stable in addition to easily replaceable.

Referring to FIG. 3, the trigger 105 can include a trigger body 106 having a trigger stem 107 extending from the trigger body 106. The trigger stem 107 can be maintained within a retainer 170 disposed within the trigger body 106. For example, the retainer 170 can include structure complimentary to a portion 175 of the trigger stem 107 to receive the trigger stem 107. Alternately, the retainer 170 can be integral with the trigger body 106. In some embodiments, the trigger body 106 can include multiple sections releasably coupled together to allow for internal access to the trigger body 106 and the trigger stem 107. For example, the trigger body 106 can be made of a clamshell configuration that couples together around the trigger stem 107 and retainer 170.

It will be appreciated that while the present invention has been described as being useful with tools, the present invention is adaptable and useful with any type of a device that uses a depressible button or trigger.

As used herein, the term "coupled" and its functional equivalents are not intended to necessarily be limited to a direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and/or described, it will be apparent to those skilled in the art that changes and modifications may be made without departing from the broader aspects of the invention. The actual scope of the protection sought is intended to be defined in the following claims when viewed in their proper perspective.

What is claimed is:

1. A trigger retention mechanism for a device having a housing and a depressible trigger, wherein the housing includes a housing wall having interior and exterior surfaces, the trigger retention mechanism comprising:

a trigger body and a trigger stem extending from the trigger body;

a bushing having a flange, a tube extending from the flange, and ridges circumferentially disposed on the tube, wherein the flange is adapted to be disposed proximal to the exterior surface, wherein the tube slidably receives the trigger stem, and wherein the ridges are adapted to create a friction-fit interaction between the bushing and the housing; and a fastener adapted to be releasably coupled to the bushing proximal to the interior surface and substantially prevent axial movement of the bushing relative to the housing.

2. The trigger retention mechanism of claim 1, further comprising an O-ring disposed between two of the ridges.

3. The trigger retention mechanism of claim 1, wherein the fastener is coupled to the tube inside the housing.

4. The trigger retention mechanism of claim 3, wherein the fastener is disposed substantially flush with the interior surface.

5. The trigger retention mechanism of claim 1, wherein the fastener is disposed adjacent to the interior surface and the flange is disposed adjacent to the exterior surface, wherein the fastener and the flange sandwich the housing wall.

6. The trigger retention mechanism of claim 1, wherein the fastener is an E-clip.

7. The trigger retention mechanism of claim 1, further comprising a retainer disposed within the trigger body and adapted to retain extension of the trigger stem relative to the trigger body.

8. The trigger retention mechanism of claim 7, wherein the trigger body includes a first trigger body portion and a second trigger body portion releasably coupled to the first trigger body portion.

9. A tool having a housing and a depressible trigger with a trigger body and a trigger stem extending from the trigger body, wherein the housing includes a housing wall having exterior and interior surfaces, comprising:

a bushing having a flange, a tube extending from the flange, and ridges circumferentially disposed around the tube, wherein the flange is adapted to be disposed proximal to the exterior surface, wherein the tube slidably receives the trigger stem, and wherein the ridges are adapted to create a friction-fit interaction between the bushing and the housing; and a fastener adapted to releasably couple to the bushing proximal to the interior surface and substantially prevent axial movement of the bushing relative to the housing.

10. The tool of claim 9, further comprising an O-ring disposed between two of the ridges.

11. The tool of claim 9, wherein the fastener is coupled to the tube adjacent to the interior surface.

12. The tool of claim 11, wherein the fastener is disposed substantially flush with the interior surface.

13. The tool of claim 9, wherein the fastener is disposed adjacent to the interior surface and the flange is disposed adjacent to the exterior surface, and wherein the fastener and the flange sandwich the housing wall.

14. The tool of claim 9, wherein the fastener is an E-clip releasably coupled to the tube.

15. The tool of claim 9, further comprising a retainer disposed within the trigger body that is adapted to retain the trigger stem relative to the trigger body.

16. The tool of claim 15, wherein the trigger body includes a first trigger body portion and a second trigger body portion releasably coupled to the first trigger body portion.

17. A method of replacing a trigger mechanism of a device having a housing including a housing wall having first and second surfaces, the method comprising:

removing a fastener circumferentially coupled around a tube of a bushing proximal to the second surface, and that substantially prevents axial movement of the bushing;

applying a force to a flange extending from the tube that is disposed proximal to the first surface to overcome resistance from a friction-fit interaction between the housing and ridges of the bushing that are disposed circumferentially around the tube; and disposing a second bushing in the housing in a friction-fit interaction.

18. The method of claim 17, further comprising disposing an O-ring circumferentially around the second bushing.

* * * * *